US009187964B2

(12) United States Patent
Harms

(10) Patent No.: US 9,187,964 B2
(45) Date of Patent: Nov. 17, 2015

(54) MANDREL LOADING SYSTEMS AND METHODS

(71) Applicant: Kent David Harms, Richmond, TX (US)

(72) Inventor: Kent David Harms, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 405 days.

(21) Appl. No.: 13/622,457

(22) Filed: Sep. 19, 2012

(65) Prior Publication Data

US 2013/0075163 A1 Mar. 28, 2013

Related U.S. Application Data

(60) Provisional application No. 61/536,835, filed on Sep. 20, 2011.

(51) Int. Cl.

| | |
|---|---|
| ***E21B 47/01*** | (2012.01) |
| ***E21B 17/20*** | (2006.01) |
| ***E21B 17/07*** | (2006.01) |
| *E21B 17/02* | (2006.01) |

(52) U.S. Cl.

CPC ..... *E21B 17/20* (2013.01); *E21B 17/07* (2013.01); *E21B 47/01* (2013.01); *E21B 17/023* (2013.01)

(58) Field of Classification Search

CPC ..... E21B 17/02; E21B 17/023; E21B 17/16; E21B 17/17; E21B 17/20; E21B 47/01; E21B 47/011

See application file for complete search history.

(56) References Cited

U.S. PATENT DOCUMENTS

| | | | | |
|---|---|---|---|---|
| 4,223,746 | A | 9/1980 | Tanguy et al. | |
| 4,276,947 | A * | 7/1981 | Hebel | 175/321 |
| 4,311,197 | A * | 1/1982 | Hushbeck | 166/373 |
| 4,398,898 | A * | 8/1983 | Odom | 464/20 |
| 4,406,335 | A * | 9/1983 | Koot | 175/317 |
| 4,632,193 | A * | 12/1986 | Geczy | 175/65 |
| 5,320,169 | A * | 6/1994 | Delatorre | 166/113 |
| 5,417,291 | A | 5/1995 | Leising | |
| 6,230,557 | B1 | 5/2001 | Ciglenec et al. | |
| 6,761,230 | B2 | 7/2004 | Cross et al. | |
| 7,367,394 | B2 | 5/2008 | Villareal et al. | |
| 7,543,659 | B2 | 6/2009 | Partouche et al. | |
| 7,757,552 | B2 | 7/2010 | Bogath et al. | |
| 7,779,933 | B2 | 8/2010 | Sihler et al. | |
| 2005/0205304 | A1 * | 9/2005 | Gurjar et al. | 175/75 |
| 2007/0256865 | A1 * | 11/2007 | Cruickshank | 175/61 |
| 2009/0023502 | A1 * | 1/2009 | Koger | 464/20 |

* cited by examiner

*Primary Examiner* — Robert E Fuller
*Assistant Examiner* — David Carroll
(74) *Attorney, Agent, or Firm* — Cathy Hewitt; Kenneth L. Kincaid

(57) ABSTRACT

A downhole tool includes first and second collars, each including a chassis portion. A first axial load device is disposed in the first collar to exert axial force on the respective chassis portion disposed in the first collar. A second axial load device is disposed in the second collar to exert axial force on the respective chassis portion disposed in the second collar. A collar connector is coupled to the first and second collars and compresses the first axial load device.

21 Claims, 5 Drawing Sheets

MANDREL LOADING SYSTEMS AND METHODS

CROSS-REFERENCE TO RELATED APPLICATIONS

This application claims the benefit of U.S. Provisional Application No. 61/536,835, entitled "Axially Loading Long Mandrels in Drilling Tools," filed Sep. 20, 2011, the entire disclosure of which is hereby incorporated herein by reference.

BACKGROUND

The disclosure relates generally to systems and methods for loading mandrels in collars of downhole tools. Wellbores (also known as boreholes) are drilled to penetrate subterranean formations for hydrocarbon prospecting and production. During drilling operations, evaluations may be performed on the subterranean formation for various purposes, such as to locate hydrocarbon-producing formations and manage the production of hydrocarbons from these formations. To conduct formation evaluations, the drill string may include one or more drilling tools that test and/or sample the surrounding formation, or the drill string may be removed from the wellbore, and a wireline tool may be deployed into the wellbore to test and/or sample the formation. These drilling tools and wireline tools, as well as other wellbore tools conveyed on coiled tubing, drill pipe, casing or other conveyers, are also referred to herein as "downhole tools." Downhole tools may be made up of individual collars that are connected together, for example, by threaded connections, to form the tool. The collars may house one or more modules designed to provide functionality, such as power, telemetry, pressure testing, and sampling, among others. The modules may be made up of one or mandrels that are subjected to axial shock, vibration, and thermal expansion. To minimize these effects, the modules may be loaded in compression with an axial load device (ALD) in the collar.

SUMMARY

The present disclosure relates to a downhole tool that includes a first collar, a second collar, a first chassis portion disposed in the first collar, and a second chassis portion disposed in the second collar. The downhole tool also includes a first axial load device disposed in the first collar to exert axial force on the first chassis portion, and a second axial load device disposed in the second collar to exert axial force on the second chassis portion. The downhole tool further includes a collar connector coupled to the first collar and the scoop collar and compressing the first axial load device.

The present disclosure also relates to a downhole tool that includes a first collar, a second collar, a first chassis portion disposed in the first collar and abutting an internal shoulder of the first drill collar, and a second chassis portion disposed in the second collar. The first collar includes a first field connection end and a first tapered portion disposed on an opposite end from the first field connection end. The second collar includes a second field connection end and a second tapered portion disposed on an opposite end from the second field connection end. The first chassis portion includes a first mandrel sub assembly, an axial loading mandrel extension coupled to the first mandrel sub assembly, and an intermediate mandrel extension coupled to the axial loading mandrel extension. The second chassis portion includes a connecting mandrel extension coupled to the intermediate mandrel extension, and to second mandrel sub assembly coupled to the connecting mandrel extension. The downhole tool also includes a first, axial load device disposed in the first collar to exert, axial force on the first chassis portion, and a second axial load device disposed in the second collar to exert axial force on the second chassis portion. The downhole tool further includes a collar connector coupled to the first collar and the second collar and compressing the first axial load device. The downhole tool also includes a top sub coupled to the second collar and compressing the second axial load device.

The present disclosure further relates to a method that includes loading a first chassis portion into as first collar of a downhole tool and compressing, the first chassis portion in the first collar using a collar connector and a first axial load device. The method further includes coupling a second chassis portion to the first chassis portion, disposing a second collar around the second chassis portion, and compressing the second chassis portion in the second collar using a top sub and a second axial load device.

DETAILED DESCRIPTION

It is to be understood that the present disclosure provides many different embodiments, or examples, for implementing different features of various embodiments. Specific examples of components and arrangements are described below to simplify the present disclosure. These are, of course, merely examples and are not intended to be limiting.

The present disclosure relates to mandrel loading techniques for downhole tools. Downhole tools generally include a series of collars that are connected together in the field (e.g., at the rig site) to form the downhole tool. Mandrel subassemblies are coupled together within the collar to form a chassis for a field connection segment, which may include one or more collars that extend between field connection ends. When placed downhole, the chassis may be subjected to effects such as axial shock, vibration, and thermal expansion. To compensate for these effects, the chassis may be loaded into the collar in compression with an Axial Load Device (ALD). The size of the ALD device may be proportional to the weight of the chassis. In order to provide several functionalities, such as sampling, power requirements, and fluid analysis, within a downhole tool, chassis length may increase and therefore larger ALDs may be desired. Rather than providing a single ALD device for a chassis, the present techniques allow multiple ALDs to be included within a chassis of a field connection segment to absorb the axial load on the chassis.

Figure 1:
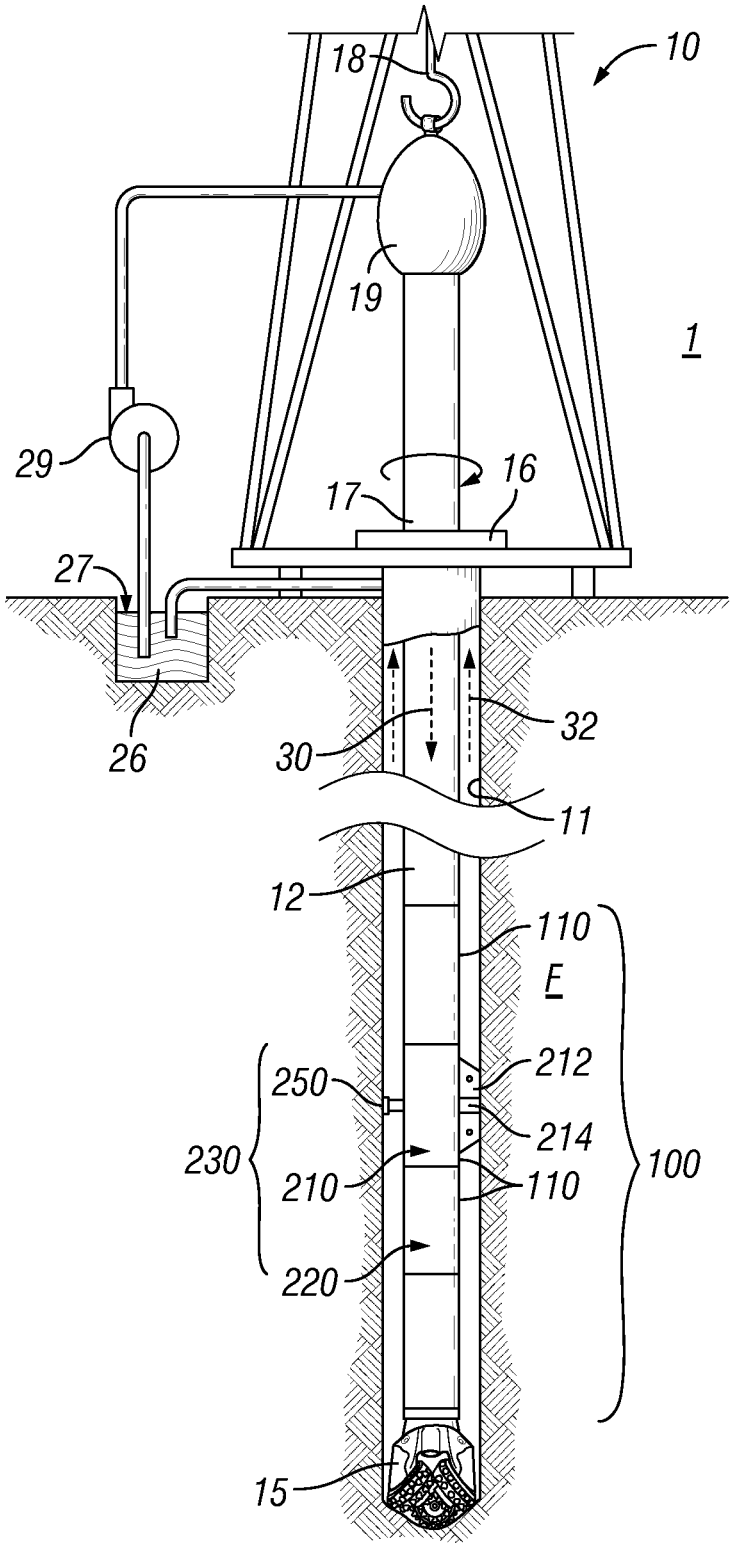
FIG. 1 depicts an embodiment of a wellsite drilling system that may employ mandrel loading systems and methods in accordance with aspects of the present disclosure.

FIG. 1 illustrates a wellsite drilling system 10 that may employ the mandrel connections and techniques described herein. The wellsite system 10 may be located onshore or offshore. In this exemplary wellsite system 10, a borehole 11 is formed in subsurface formations by rotary drilling. Embodiments of the mandrel connections and techniques described herein also may be used with directional drilling, with wireline tools, and with wired drill pipe, among others.

The wellsite drilling system 1 including a rig 10 with a downhole tool 100 suspended therefrom and into the wellbore 11 via a drill string 12. The downhole tool 100 has a drill bit 15 disposed on its lower end that is used to advance the downhole tool into the formation and form the wellbore. At the surface, the wellsite drilling system 10 includes the rig 10 positioned over the borehole 11. The rig 10 includes a rotary table 16, a kelly 17, a hook 18, and a rotary swivel 19. The drill string 12 is rotated by the rotary table 16, which engages the kelly 17 at the upper end of the drill string. The drill string 12 is suspended from the hook 18, attached to a traveling block (not shown), through the kelly 17 and the rotary swivel 19, which permits rotation of the drill string relative to the hook 18. In the example of this embodiment, the surface system further includes drilling fluid 26 (e.g., drilling mud) stored in a pit 27 formed at the well site. A pump 29 delivers the drilling fluid 26 to the interior of the drill string 12 via a port in the swivel 19, causing the drilling fluid to flow downwardly through the drill string 12, as indicated by the directional arrow 30. The drilling fluid 26 exits the drill string 12 via ports in the drill bit 15, and then circulates upwardly through the annulus region between the outside of the drill string and the wall of the borehole, as indicated by the directional arrows 32. Accordingly, the drilling fluid 26 lubricates the drill bit 15 and carries formation cuttings up to the surface as it is returned to the pit 27 for recirculation.

The downhole tool 100, sometimes referred to as a bottom hole assembly ("BHA"), is preferably positioned near the drill bit 15 (in other words, within several drill collar lengths from the drill bit). The bottom hole assembly includes various components with capabilities, such as measuring, processing, and storing information, as well as communicating with the surface, that may be disposed within collars 110 of the downhole tool 100. For example, one of the collars 110 may house a telemetry device for communicating with a surface controller (not shown) included within the rig 1, while another collar 110 may house a power module. The collars 110 may be connected together using mandrel extensions, as discussed further below.

Multiple collars 110 may house a sampling while drilling ("SWD") system 230 that includes a fluid communication module 210 and a sample module 220. As shown in FIG. 1, the SWD system 230 includes two modules. However, in other embodiments, any number of collars 110 and modules may be included within the SWD system 230. The fluid communication module 220 includes a probe 214 for establishing fluid communication with the formation F and drawing fluid into the tool 100. The probe 214 may be positioned in a stabilizer blade 212 and may be extended therefrom to engage the wall of the borehole 11. The stabilizer blade 212 includes one or more blades that are in contact with the borehole wall. One or more backup pistons 250 also may be provided to assist in applying force to push the drilling tool 100 and/or probe 214 against the borehole wall. Fluid drawn into the downhole tool using the probe 214 may be measured to determine, for example, pretest and/or pressure parameters. Further, a portion of the formation fluid drawn into the tool 100 may be stored within sample chambers included within the sample module 220. In certain embodiments, the sample module 220 may include a pumping system for drawing fluid though the tool 100.

Figure 2:
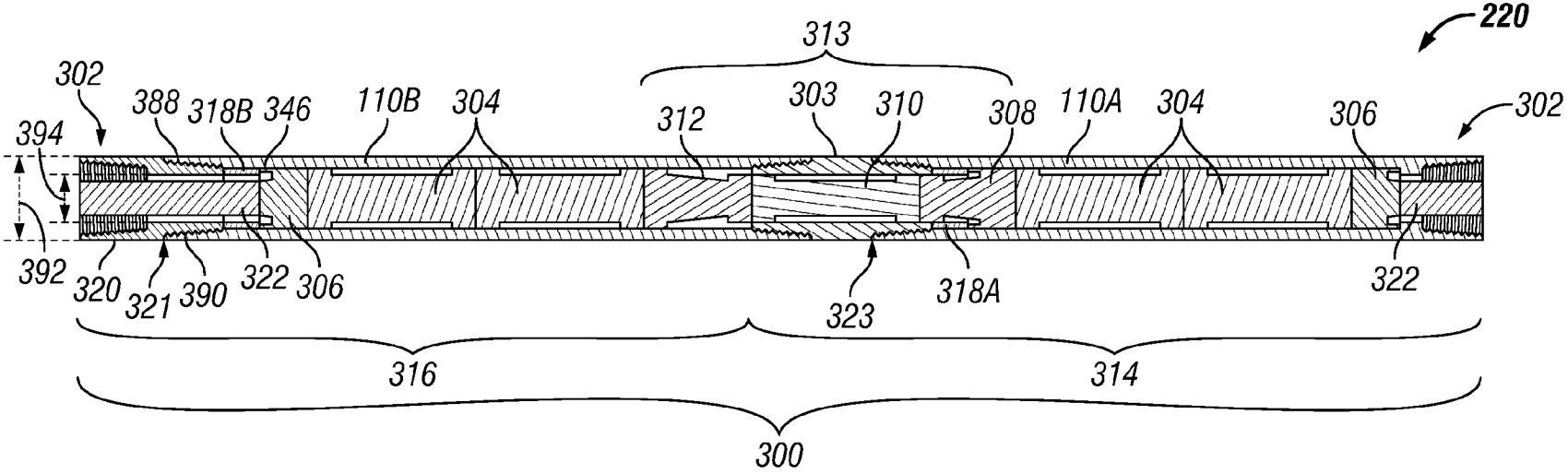
FIG. 2 is a cross-sectional view of a module of FIG. 1.

FIG. 2 is a cross-sectional view of the sample module 220 of FIG. 1. Although aspects of the present techniques will be described herein with reference to the sample module 220, the techniques may be applied to any suitable modules and/or field connection segments of a downhole tool. The module 220 includes a chassis 300 that extends between two field connection ends 302. The field connection ends 302 may include threaded connections designed to be coupled to ends of other modules or field connection segments at the rig site. The connections made at the field connection ends 302 may allow power and fluids to be passed between modules of the downhole tool 100. However, because these connections are designed to be assembled and disassembled at the rig site, the field connections may be less robust than the connections within the chassis 300. Further, because the field connections may be rotatable to facilitate assembly in the field, the amount of power and fluid that can be passed by these connections may be limited, as compared to the amount of power and fluid that can be passed by the internal chassis connections, which may be fixed in place, allowing for more complex connections.

The chassis 300 is housed in two collars 110A and 110B that are joined by a collar connector 303. According to certain embodiments, collar 110A may be located on the downhole end of the tool. The chassis 300 includes several mandrel sub assemblies 304, which may house sensors, gauges, sample chambers, electronics, and other components designed to provide functionality for the module 220. As discussed further below, the outermost mandrel sub assemblies 304 may be coupled to flow diverters 306 designed to direct drilling fluid into and out of the module 220. The chassis 300 further includes mandrel extensions 308, 310, and 312 that connect the mandrel sub assemblies 304 within collars 110A and 110B. The mandrel extensions 308, 310, and 312, along with the collar connector 303 form a shop connection portion 313, which represents a rugged connection that may be made on the manufacturing floor or at a base location prior to transporting the module 220 to the rig site.

The chassis 300 includes a first chassis portion 314, which is housed by the first collar 110A, and a second chassis portion 316, which is housed by the second collar 110B. The shop connection portion 313 connects the first and second chassis portion 314 and allows power, data, and/or fluids to be passed between the first and second chassis portions 314 and 316. According to certain embodiments, the mandrel extensions 308, 310, and 310 may include non-rotatable connections, such as pin-to-pin connections and fluid couplings, designed to transfer power, data, and/or fluid through the chassis 300. An ALD 318A is disposed within the shop connection portion 313 to absorb axial loading of the first chassis portion 314. The ALD 318A also may exert axial force on the first chassis portion. Further, an ALD 318B is disposed within the second collar 110B to absorb axial loading of the second chassis portion 316. The ALD 318B also may exert axial force on the second chassis portion. According to certain embodiments, the ALDs 318A and 318B may be spring washers, such as Belleville washers, that are sized to absorb the loading of each chassis portion. The ALD 318A for the first chassis portion 314 is compressed by the collar connector 303, and the ALD 318B for the second chassis portion 316 is compressed by a top sub 320. The top sub 320 forms part of the field connection end 302, and the end of the top sub 320 opposite from the ALD 318B may be designed to be connected in the field to another module. Each field connection end 302 may include an extender 322, which is designed to pass certain power, data, and/or fluid between the modules of the downhole tool 100.

Rather than including a single ALD 318B within the chassis 300, the collar connector 303, allows for a second. ALD 318A to be included within the module 220 to absorb part of the load of the chassis 300. Although only one shop connection portion 313 and collar connector 303 is shown within the module 220, in other embodiments, any number of shop connection portions 313 and collar connectors 303 may be included within a module. Accordingly, the load for a single chassis 300 that extends between adjacent field connection ends 302 can be absorbed by two or more ALDs, which may allow each ALD to be smaller in size, as compared to a single ALD used for the entire chasses. The smaller ALDs may require less torque for compression, which in turn may allow more of the torque provided by the threaded connections of the collar connector 303 and the top sub 320 to be applied to the seal faces 321 and 323 between the top sub 320 and the collar 110B, and the collar connector 303 and the collar 110A, respectively.

Figure 3:
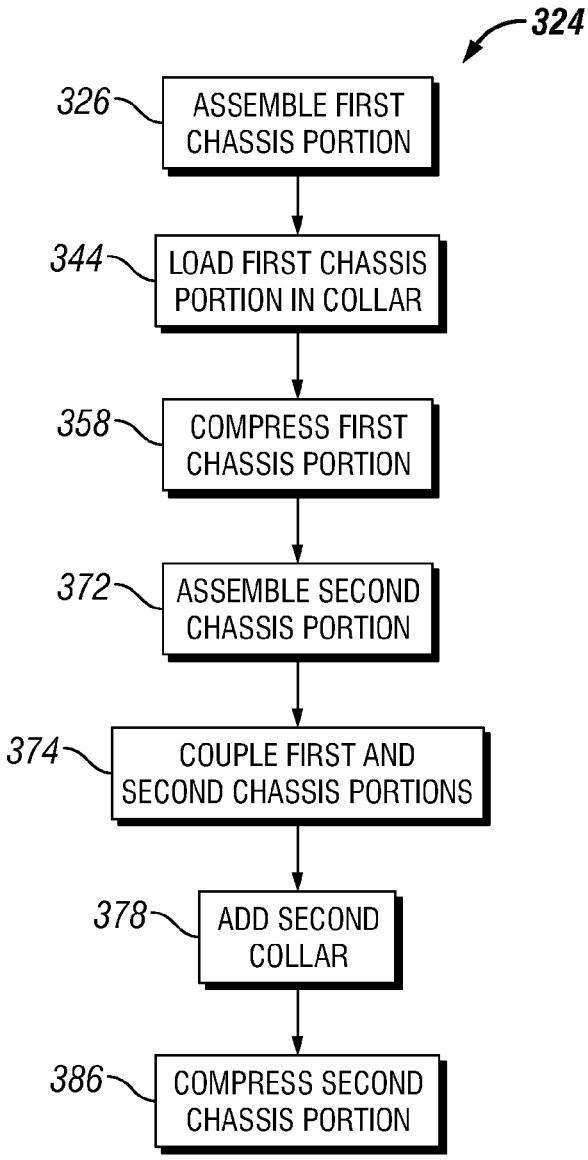
FIG. 3 is a flow chart of an embodiment of a method that may be employed to load mandrel sub assemblies within collars to form a chassis.
Figure 4:
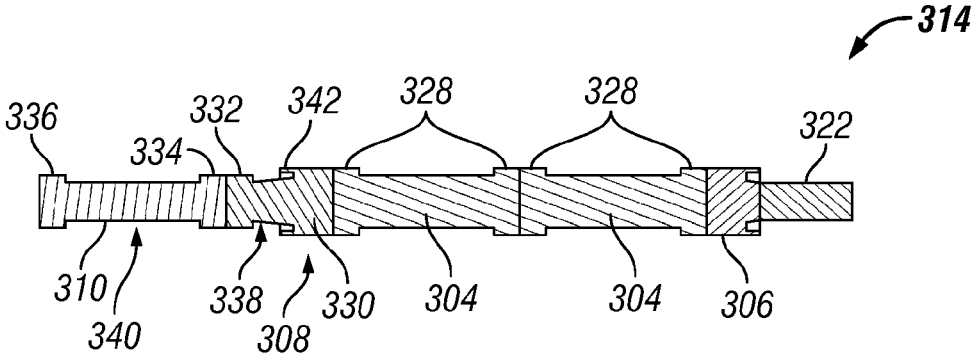
FIGS. 4 through 8 are cross-sectional views depicting assembly of the module of FIG. 2 in accordance with aspects of the present disclosure.

FIG. 3 depicts a method 324 that may be employed to assembly the chassis 300 and load the chassis 300 into the collars 110A and 110B. The method 324 may begin by assembling (block 326) the first chassis portion 314. For example, as shown in FIG. 4, the first chassis portion 314 may be assembled by bolting, coupling, or otherwise fastening, flanges 328 of the mandrel sub assemblies 304 to the flow diverter 306 and to one another. A flange 328 of a sub mandrel assembly 304 also may be bolted, coupled, or otherwise fastened, to a large flange 330 of the axial loading mandrel extension 308. As discussed further below, the axial loading mandrel extension 308 includes a shoulder 342 designed to receive the ALD 318A. The axial loading mandrel extension 308 also includes a smaller flange 332 that may be bolted, coupled, or otherwise fastened, to a flange 334 of the intermediate mandrel extension 310. As shown in FIG. 4, the axial loading mandrel extension 308 and the intermediate mandrel extension 310 are separate components. However, in other embodiments, the axial loading mandrel extension 308 and the intermediate, mandrel extension 310 may be a single, unitary piece. The intermediate mandrel extension 310 also includes a flange 336 that may be coupled to the connecting mandrel extension 312, as discussed further below with respect to FIG. 7. Further, the mandrel extensions 308 and 310 each include a recessed portion 338 and 340, respectively, designed to divert drilling fluid through the module 220.

Figure 5:
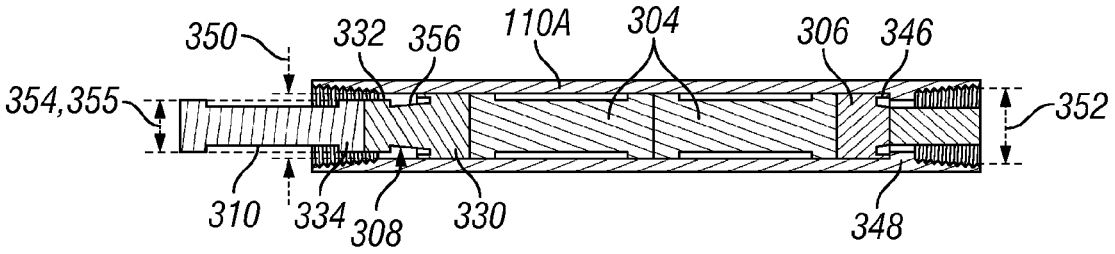

After assembly, the first chassis portion 314 may be loaded (block 344, FIG. 3) into the first collar 110A. As shown in FIG. 5, first chassis portion 314 may be inserted into the first drill collar 110A so that a shoulder 346 of the flow diverter 306 abuts an internal shoulder 348 of the first drill collar 110A. The axial loading mandrel extension 308 includes an outer diameter 350, located on the large flange 330, that generally abuts the interior wall of the first collar 110A. Accordingly, the outer diameter 350 of the axial loading mandrel extension 308 may be approximately equal to an inner diameter 352 of the first drill collar 110. The smaller flange 332 of the axial loading mandrel extension 308 includes an outer diameter 354 that is generally smaller than the outer diameter 350 of the large flange 330 and the inner diameter 352 of the first collar 110A. As described below with respect to FIG. 6, the smaller outer diameter 354 may allow insertion of the ALD 318A into the first collar 110A. The axial loading mandrel extension 308 also includes a conical section 356 that connects the large flange 330 and the small flange 332, and that generally tapers from the large flange 330 to the small flange 332. The flanges 334 and 336 of the intermediate mandrel extension 310 also have an outer diameter 355 that is approximately equal to the smaller outer diameter 354 of the axial loading mandrel extension 308, which may also allow insertion of the ALD 318A into the first collar 110A.

Figure 6:
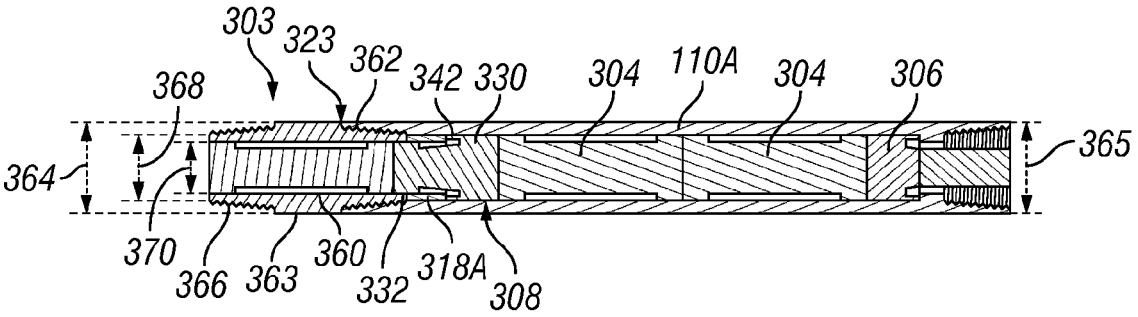

After the first chassis portion 314 is loaded into the first collar 110A, the first chassis portion 314 may be compressed (block 358, FIG. 3) within the first collar 110 by insertion of the ALD 318A and the collar connector 303. As shown in FIG. 6, the 318A may be disposed within the first collar 110A around the smaller flange 332 of the axial loading mandrel extension 308 so that the ALD 318A abuts the shoulder 342 of the large flange 330. The collar connector 303 may then be coupled to the first collar 110A so that a tapered portion 360 of the collar connector 303 mates with a tapered portion 362 of the first collar 110A. According to certain embodiments, the tapered portions 362 and 360 may be threaded connections. The tapered portions 362 and 360 may be coupled together to compress the ALD 318A within the first collar 110A. The collar connector 303 includes an intermediate portion 363 that has an outer diameter 364 that is approximately equal to, or greater than, the outer diameter 365 of the first collar 110A. Further, the outer diameter 364 of the collar connector 303 may be approximately equal to, or greater than, the outer diameter 366 of the second collar 110B. Upon connection of the tapered portions 360 and 362, a seal face 323 may be formed between the drill collar 110A and the collar connector 363. In certain embodiments, the threaded connections of the tapered portions 360 and 362 may be designed to have sufficient connective strength to withstand enough torque to provide, a relatively impermeable seal at the seal face 323 and to provide compression of the ALD 318A.

The inner diameter 370 of the collar connector 303 may be relatively constant along the length of the collar connector 303 and may be approximately equal to the outer diameters 355 of the flanges 334 and 336 of the intermediate mandrel extension 310. Accordingly, the interior surface of the collar connector 303 may abut the flanges 334 and 336. The collar connector 303 also includes another tapered portion 366, disposed on an opposite end of the intermediate portion 363 from the tapered portion 360. As discussed further below with respect to FIG. 8, the tapered portion 360 may be designed to mate with a corresponding tapered portion of the drill collar 110B.

Figure 7:
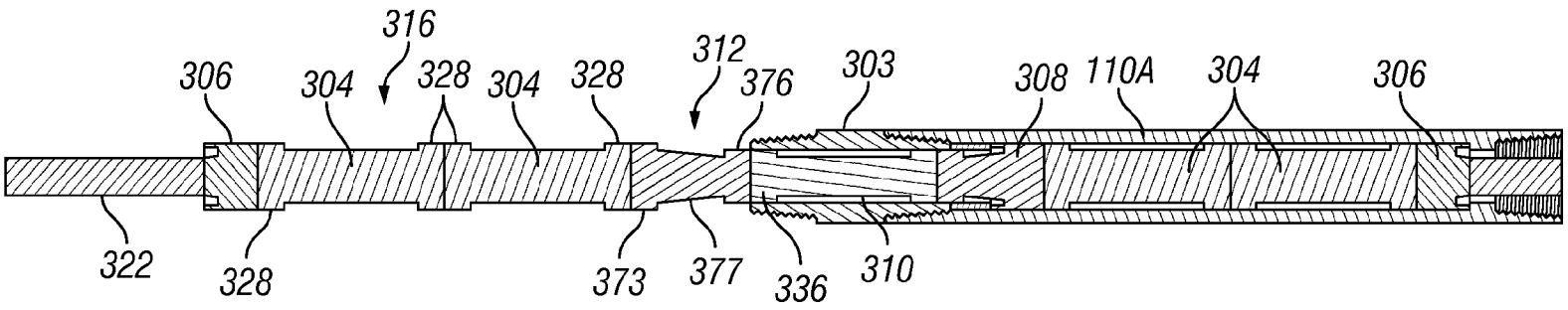

The second chassis portion 316 also may be assembled (block 372, FIG. 3) prior to loading into the tool. As may be appreciated, assembly of the second chassis portion may occur concurrent with, prior to, or after assembly (block 326) of the first chassis portion. As shown in FIG. 7, flanges 328 of the mandrel sub assemblies 304 may be bolted, coupled, or otherwise fastened, to the flow diverter 306 and to one another. A flange 328 of the mandrel sub assembly 304 also may be bolted, coupled, or otherwise fastened, to a flange 373 of the connecting mandrel extension 312.

The second chassis portion 316 may then be coupled (block 374, FIG. 3) to the first chassis portion 314. As shown in FIG. 7, a flange 376 of the connecting mandrel extension 312 may be bolted, coupled, or otherwise fastened, to a flange 336 of the intermediate mandrel extension 310. Although described above as assembling (block 372) the second chassis portion and then coupling (block 374) the first and second chassis portions, in certain embodiments, these steps may be combined and/or the order of assembly may vary. For example, in certain embodiments, the connecting mandrel extension 312 may be coupled to the intermediate mandrel extension 310 prior to connection of the mandrel sub assemblies 304 to the connecting mandrel extension 312.

Figure 8:
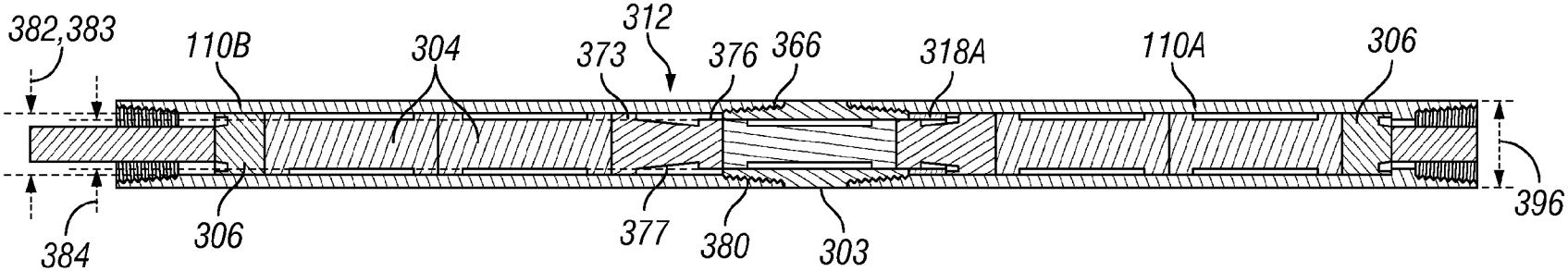

After the first and second chassis 314 and 316 are coupled together, the second collar 110B may be coupled (block 378, FIG. 3) to the assembly. As shown in FIG. 8, the second collar 110B includes a tapered portion 380 designed to mate with the tapered portion 366 of the collar connector 303. The flange 373 of the connector mandrel extension 312 may have an outer diameter 382 that is approximately equal to an inner diameter 383 of the second collar 110B, which in certain embodiments, also may be approximately equal to the inner diameter 352 of the first collar 110A. The connector mandrel extension 312 also includes a conical section 377 that tapers from the large flange 373 to the small flange 376, which has an outer diameter 384 that may be smaller than the outer diameter 382.

After connection of the second collar 110B to the collar connector 303, the second chassis portion 316 may be compressed (block 386, FIG. 3) within the second collar 110 by insertion of the ALD 318B and the top sub 320. As shown in FIG. 2, the ALD 318B may be disposed within the second collar 110B around the extender 322 so that the ALD 318B abuts the shoulder 346 of the flow diverter 306. The top sub 320 may then be coupled to the second collar 110B so that a tapered portion 388 of the top sub 320 mates with a tapered portion 390 of the second collar 110B. According to certain embodiments, tapered portions 388 and 390 may be threaded connections. The tapered portions 388 and 390 may be coupled together to compress the ALD 318B within the second collar 110B. The top sub 320 has an outer diameter 392 that is approximately equal to the outer diameter 366 of the second collar 110B (FIG. 8). Upon connection of the tapered portions 388 and 390, the seal face 321 may be formed between the drill collar 110B and the top sub 320. In certain embodiments, the threaded connections of the tapered portions 388 and 390 may be designed to have sufficient connective strength to withstand enough torque to provide a relatively impermeable seal at the seal face 321 and to provide compression of the ALD 318B.

As discussed above, the inclusion of two or more ALDs 318A and 318B within the chassis 300 allows the axial load of the chassis 300 to be distributed across multiple ALDs, allowing each ALD 318A and 318B to be smaller, and employ less compressive force. Because less compressive force is employed for an individual ALD 318A or 318B, more of the torque applied to the threaded connections (e.g., tapered portions 360, 362, 388, 390) is available for the seal face 323 or 321, which in turn may improve the integrity of the seal face.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A downhole tool comprising:

a first collar;

a first chassis portion disposed in the first collar;

a first axial load device disposed in the first collar to exert axial force on the first chassis portion;

a second collar;

a second chassis portion disposed in the second collar;

a second axial load device disposed in the second collar to exert axial force on the second chassis portion; and a collar connector coupled to the first collar and the second collar and compressing the first axial load device;

wherein the first chassis portion comprises an axial loading mandrel extension that has a large flange of a first outer diameter approximately equal to an inner diameter of the first collar and a small flange of a second outer diameter smaller than the first outer diameter, and wherein the large flange comprises a shoulder abutting the first axial load device.

2. The downhole tool of claim 1, wherein the first chassis portion and the second chassis portion form a chassis extending between field connection ends of the downhole tool.

3. The downhole tool of claim 1, wherein the collar connector comprises an outer diameter approximately equal to an outer diameter of the first collar.

4. The downhole tool of claim 1, wherein the first chassis portion comprises a first mandrel subassembly, a first flow diverter, and a first mandrel extension; wherein the second chassis portion comprises a second mandrel subassembly, a second flow diverter, and a second mandrel extension; and wherein the first mandrel extension is disposed in the collar connector and coupled to the second mandrel extension.

5. The downhole tool of claim 1, wherein the second outer diameter is approximately equal to an inner diameter of the collar connector, and wherein the small flange abuts the collar connector.

6. The downhole tool of claim 1, wherein the second chassis portion comprises a top sub coupled to the second collar and compressing the second axial load device.

7. The downhole tool of claim 1, comprising a third chassis portion disposed in a third collar and a third axial load device disposed in the third collar to exert axial force on the third chassis portion.

8. A downhole tool comprising:

a first collar comprising a first field connection end and a first tapered portion disposed on an opposite end from the first field connection end;

a second collar comprising a second field connection end and a second tapered portion disposed on an opposite end from the second field connection end;

a first chassis portion disposed in the first collar and abutting an internal shoulder of the first drill collar, wherein the first chassis portion comprises a first mandrel sub assembly, an axial loading mandrel extension coupled to the first mandrel sub assembly, and an intermediate mandrel extension coupled to the axial loading mandrel extension;

a first axial load device disposed in the first collar to exert axial force on the first chassis portion;

a second chassis portion disposed in the second collar and comprising a connecting mandrel extension coupled to the intermediate mandrel extension, and a second mandrel sub assembly coupled to the connecting mandrel extension;

a second axial load device disposed in the second collar to exert axial force on the second chassis portion;

a collar connector coupled to the first collar and the second collar and compressing the first axial load device; and a top sub coupled to the second collar and compressing the second axial load device.

9. The downhole tool of claim 8, wherein the intermediate mandrel extension is disposed within the collar connector.

10. The downhole tool of claim 8, wherein the first axial loading device is disposed around the axial loading mandrel extension and abuts the collar connector.

11. The downhole tool of claim 8, wherein the connecting mandrel extension comprises a large flange of a first outer diameter approximately equal to an inner diameter of the second collar and a small flange of a second outer diameter smaller than the first outer diameter.

12. The downhole tool of claim 11, wherein the small flange is coupled to the intermediate mandrel extension and wherein the large flange is coupled to the second mandrel sub assembly.

13. The downhole tool of claim 8, wherein the collar connector comprises:

an intermediate section of an outer diameter approximately equal to a first outer diameter of the first collar and a second outer diameter of the second collar;

a third tapered portion coupled to the first tapered portion of the first collar; and a fourth tapered portion coupled to the second tapered portion of the second collar.

14. The downhole tool of claim 13, wherein the first, second, third, and fourth tapered portions comprise threaded connections.

15. A method comprising:

loading a first chassis portion into a first collar of a downhole tool;

compressing the first chassis portion in the first collar using a collar connector and a first axial load device;

coupling a second chassis portion to the first chassis portion;

disposing a second collar around the second chassis portion; and compressing the second chassis portion in the second collar using a top sub and a second axial load device;

wherein compressing the first chassis portion comprises: disposing the first axial load device around a axial loading mandrel extension of the first chassis portion; and coupling a collar connector to the first collar to compress the first axial load device against a shoulder of the axial loading mandrel extension.

16. The method of claim 15, wherein loading the first chassis portion comprises inserting the first chassis portion into the first collar to abut an internal shoulder of the first collar.

17. The method of claim 15, wherein disposing the second collar comprises coupling the second collar to the collar connector.

18. The method of claim 15, wherein compressing the second chassis portion comprises:

disposing the second axial load device around an extender of the second chassis portion; and coupling the top sub to a tapered portion of the second collar to compress the second axial load device against the second chassis portion.

19. A downhole tool comprising:

a first collar;

a first chassis portion disposed in the first collar;

a first axial load device disposed in the first collar to exert axial force on the first chassis portion;

a second collar;

a second chassis portion disposed in the second collar;

a second axial load device disposed in the second collar to exert axial force on the second chassis portion; and a collar connector coupled to the first collar and the second collar and compressing the first axial load device;

wherein the first chassis portion comprises a first mandrel subassembly, a first flow diverter, and a first mandrel extension; wherein the second chassis portion comprises a second mandrel subassembly, a second flow diverter, and a second mandrel extension; and wherein the first mandrel extension is disposed in the collar connector and coupled to the second mandrel extension.

20. A downhole tool comprising:

a first collar;

a first chassis portion disposed in the first collar;

a first axial load device disposed in the first collar to exert axial force on the first chassis portion;

a second collar;

a second chassis portion disposed in the second collar;

a second axial load device disposed in the second collar to exert axial force on the second chassis portion; and a collar connector coupled to the first collar and the second collar and compressing the first axial load device;

wherein the second chassis portion comprises a top sub coupled to the second collar and compressing the second axial load device.

21. A method comprising:

loading a first chassis portion into a first collar of a downhole tool;

compressing the first chassis portion in the first collar using a collar connector and a first axial load device;

coupling a second chassis portion to the first chassis portion;

disposing a second collar around the second chassis portion; and compressing the second chassis portion in the second collar using a top sub and a second axial load device; wherein compressing the second chassis portion comprises: disposing the second axial load device around an extender of the second chassis portion; and coupling the top sub to a tapered portion of the second collar to compress the second axial load device against the second chassis portion.

* * * * *